US005526655A

United States Patent [19]

Iida

[11] Patent Number: 5,526,655

[45] Date of Patent: Jun. 18, 1996

[54] CAM MECHANISM FOR CIRCULAR KNITTING MACHINE AND CAM TIMING SETTING METHOD

[75] Inventor: Yukiari Iida, Hyogo, Japan

[73] Assignee: Precision Fukuhara Works, Ltd., Japan

[21] Appl. No.: 447,688

[22] Filed: May 23, 1995

[30] Foreign Application Priority Data

Jun. 2, 1994 [JP] Japan ..... 6-145604
Dec. 6, 1994 [JP] Japan ..... 6-330682

[51] Int. Cl.[6] ..... D04B 15/32

[52] U.S. Cl. ..... 66/57; 66/19; 66/38

[58] Field of Search ..... 66/19, 20, 38, 66/57

[56] References Cited

U.S. PATENT DOCUMENTS

| | | | |
|---|---|---|---|
| 2,544,829 | 3/1951 | Gilbreath | 66/57 X |
| 3,252,305 | 5/1966 | Noll | 66/57 X |
| 3,299,673 | 1/1967 | Noll | 66/38 X |
| 3,456,460 | 7/1969 | Mishcon | 66/38 X |
| 3,848,432 | 11/1974 | Mishcon et al. | 66/57 X |
| 4,033,150 | 7/1977 | Mishcon et al. | 66/19 X |
| 5,417,086 | 5/1995 | Plath | 66/38 X |

*Primary Examiner*—John J. Calvert
*Attorney, Agent, or Firm*—Bell, Seltzer, Park & Gibson

[57] ABSTRACT

A cam mechanism and method in a circular knitting machine having at least two types of knitting needles each having a master butt and at least two selector butts and including a stitch cam for engaging the master butts and retracting the needles from the knitting and tucking positions to the stitch-forming level, and knitting, tucking and welt-guarding cams movable between extended operative positions and retracted inoperative positions, and a selection device for individually selecting and moving the knitting, tucking and welt-guarding cams between the operative and inoperative positions.

18 Claims, 5 Drawing Sheets

CAM MECHANISM FOR CIRCULAR KNITTING MACHINE AND CAM TIMING SETTING METHOD

FIELD OF THE INVENTION

The present invention relates to circular knitting machines and more particularly to a needle selection mechanism and method. Still more particularly, the present invention relates to a three-position cam mechanism and method for use in a circular knitting machine.

BACKGROUND OF THE INVENTION

In the operation of circular knitting machines, the knitting needles are moved upwardly and downwardly in the tracks or grooves of the needle cylinder by cam mechanisms that engage butts on the knitting needle as the cylinder rotates. Certain circular knitting machines include both a needle cylinder and a dial with knitting needles sliding outwardly and inwardly in grooves or tracks in the dial. In such certain circular knitting machines, two sets of cam mechanisms are provided and the timing of the operation of the two sets of knitting needles and cam mechanisms must be properly coordinated.

Most, if not all, circular knitting machines currently being manufactured and sold are multiple-feed knitting machines with, for example, 48 feeds around a 30 inch diameter needle cylinder and dial. It is desirable to provide a needle selection mechanism which permits selection of any one of three needle positions for the knitting needles at each of these multiple feeds.

My U.S. Pat. No. 4,956,981, assigned to the assignee of this application, discloses a needle selection system in a multiple feed circular knitting machine that permits such selection of any one of three dial needle positions at each of the yarn feeds. While providing a needle selection system which accomplished many of the desired functions of such a needle selection system, my prior needle selection system had several disadvantages and deficiencies.

Foremost among these disadvantages and deficiencies is that this prior needle selection system required guide or cam parts that are very small (microcams) that are complicated and expensive to manufacture and are highly susceptible to being broken when removed from the knitting machine. Moreover, such microcam parts do not limit unnecessary and undesirable movements of the knitting needles when in the tucking and welting positions. Also, my prior needle selection system could not accommodate a fourth dial needle position (i.e. a supporting or withdrawn position) without changing the cam positions of the knitting and tucking cams. A still further deficiency of my prior needle selection system, as disclosed in U.S. Pat. No. 4,956,981, is that the knitting needles are advanced to the knitting position by engagement with both a tucking cam and a knitting cam which can lead to instability in the needle operation at high knitting speeds. Finally, there is a danger with my prior needle selection system when the dial knitting needles are in the supporting and welt positions, that these needles may prevent the supply of yarn to the knitting needles that are in the knitting or tucking positions.

SUMMARY OF THE INVENTION

With the foregoing in mind, it is an object of the present invention to provide an improved needle selection mechanism and method which overcome the aforementioned disadvantages and deficiencies of prior needle selection systems.

It is a more specific object of the present invention to provide a needle selection mechanism and method that is capable of selecting any one of four needle positions at each yarn feed without changing cam positions and which is less complicated and less costly to manufacture and which is less susceptible to breakage.

These objects of the present invention are accomplished by an improved needle selection mechanism in a circular knitting machine that includes at least two types or kinds of knitting needles, each having a master butt and at least two selector butts arranged at different butt positions from the master butts. The needle selection mechanism includes a cam system including a stitch cam which engages the master butts of all of the knitting needles to move the knitting needles to stitch-forming level, and selector cams which selectively engage the selector butts of the knitting needles for moving the knitting needles to and from any one of three needle positions, i.e., knitting, tucking or welting positions. These selector cams are devoid of micro cam parts and limit movement of the knitting needles in the tucking and welting positions to prevent any undesirable movement thereof. The selector cams further include a knitting cam which moves the knitting needles to the knitting position without assistance from a tucking cam.

The cam mechanism further includes a cam selection and moving mechanism which selects and moves the various selector cams into and out of the path of the selector butts of the knitting needles. Preferably, the cam mechanism of the present invention is also capable of moving and maintaining the knitting needles in a fourth position, i.e., a supporting or withdrawn position, wherein the needles cannot interfere with the feeding of yarn to the other needles.

The present invention will now be described more fully hereinafter with reference to the accompanying drawings, in which preferred embodiments of the invention are shown. This invention may, however, be embodied in many different forms and should not be construed as limited to the embodiments set forth herein; rather, the embodiments are provided so that this disclosure will be thorough and complete and will fully convey the scope of the invention to those skilled in the art.

DETAILED DESCRIPTION OF THE PREFERRED EMBODIMENTS

Figure 1:
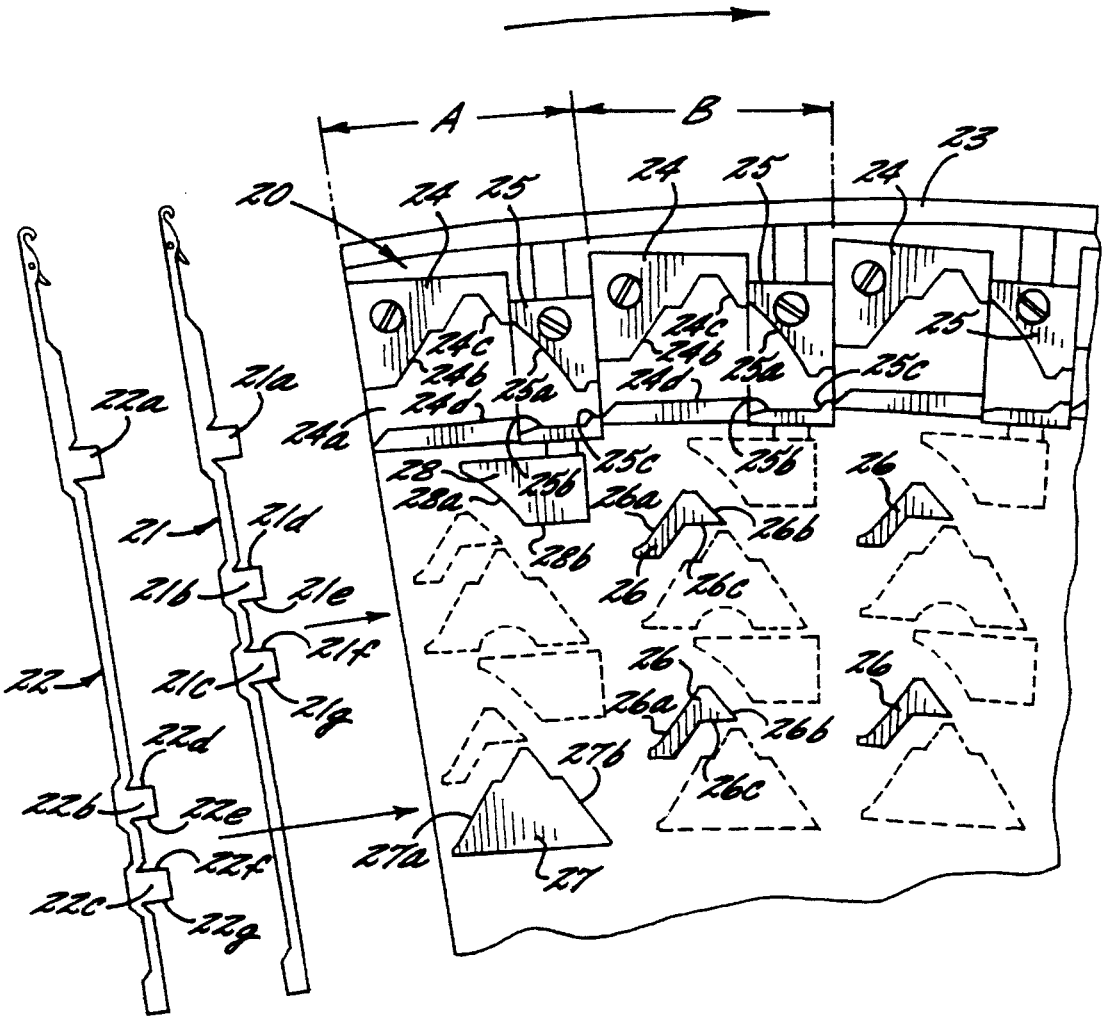
FIG. 1 is a fragmentary, rear elevation of a cam mechanism of the present invention with an elevation of two kinds or types of knitting needles used with this cam mechanism.
Figure 2:
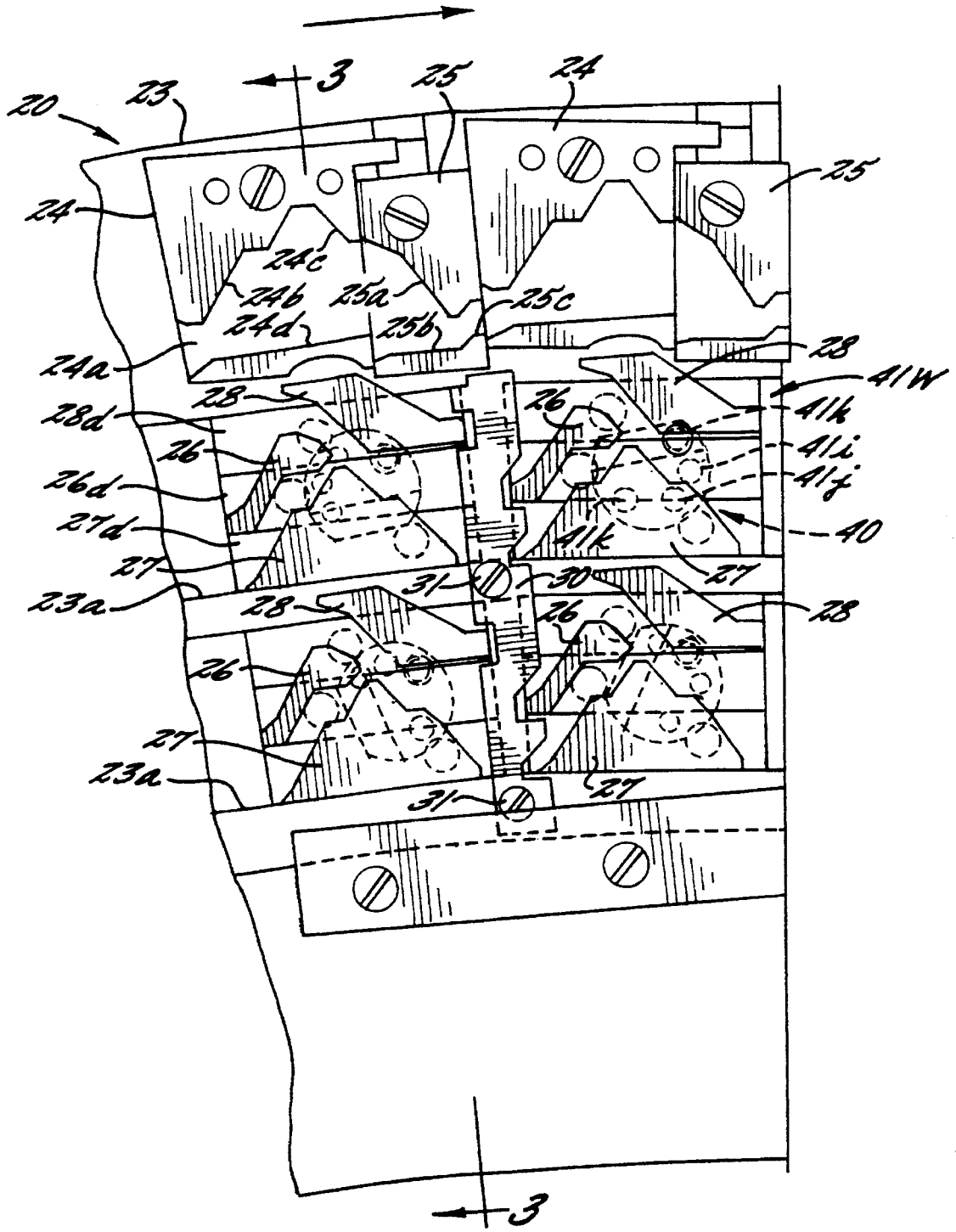
FIG. 2 is an enlarged, fragmentary view of the cam mechanism shown in FIG. 1.

Referring now more particularly to the drawings and specifically to FIGS. 1 and 2, there is shown a dial cam mechanism generally referred to at 20. The cam mechanism 20 is mounted on the dial of a circular knitting machine which also includes a needle cylinder rotating in synchronism with the dial (all of these circular knitting machine elements being not shown).

The dial includes a multiplicity of radial slots or grooves in which are slidably mounted two kinds of knitting needles 21 and 22. The knitting needles 21 are mounted in alternate grooves in the dial while needles 22 are mounted in intervening grooves in the dial. Knitting needle 21 has a master butt 21*a*, a first selector butt 21*b* and a second selector butt 21*c* thereon, the selector butts 21*b* and 21*c* being spaced apart from each other and from the master butt 21*a* along the shank of the needle 21. The knitting needle 22 has a master butt 22*a*, a first selector butt 22 and a second selector butt 22*c* thereon. The master butt 22*a* on needle 22 is positioned on the shank of needle 22 at the same position as is master butt 21*a* on needle 21. The selector butts 22*b* and 22*c* on needle 22 are spaced the same distance apart as are selector butts 21*b* and 21*c* on needle 21, but selector butts 22*b* and 21*c* are spaced further from the master butt 22*a* on needle 22 than the selector butts 21*b* and 21*c* are spaced from the master butt 21*a* on needle 21 for reasons that will become apparent as this description proceeds.

The knitting needles 21 and 22 are advanced and retracted in the dial needle grooves by the cam mechanism 20 as the dial rotates carrying the needles 21 and 22 therewith. The cam mechanism 20 defines cam paths or races along which the butts of the needles 21 and 22 travel as the dial rotates.

For ease of description, the cam mechanism 20 is illustrated as including cam sections A and B in FIG. 1. These cam sections 20A and 20B are defined by cams mounted on a cam holder 23 which is stationary and with respect to which the dial and needles 21 and 22 rotate in the direction of the arrows in FIGS. 1 and 2.

The cam sections 20A and 20B each include an outer guarding cam 24 and a stitch cam 25 mounted on cam holder 23 for guiding the master butts 21*a* and 22*a* of needles 21 and 22 in forming the knit stitches. The stitch cams 25 are mounted on cam holder 23 for radial adjustment for adjusting stitch sizes. Guarding cam 24 defines a cam race having an entrance 24*a*, an outward slanting part 24*b* for controlling advancing movement of the needles 21 and 22 to the knitting position, an inward slanting part 24*c* for initiating the retraction of the needles 21 and 22 from the knitting position to the stitch forming level, and a linear part 24*d* for controlling the inwardmost retraction of the needles 21 and 22.

Stitch cam 25, which takes over control of the needles 21 and 22 from the outer guarding cam 24, includes an inward slanting 25*a*, which generally comprises an extension of the inward slanting part 24*c* of cam 24, for continuing the retraction of the needles 21 and 22 to the stitch forming position. Cam 25 also include a linear part 25*b* for controlling the innermost retraction of the needles 21 and 22 and a receiving part 25*c* to accommodate the needles 21 and 22 when they reach the innermost retracted position.

The master butts 21*a* and 22*a* of all of the knitting needles 21 and 22 pass along the cam races defined by cams 24 and 25 and the needles are controlled thereby. Auxiliary cams are provided for engagement by the selector butts 21*b*, 21*c* and 22*b*, 22*c* of the needles 21 and 22 for further control of the needles.

Radially inward from the outer guarding cam 24 in each of the cam sections 20A and 20B are tucking cams 26 and knitting cams 27. There are provided two sets of tucking cams 26 and knitting cams 27, which sets are spaced radially apart on cam holder 23 to be engaged by the selector butts 21*b* and 21*c* of needles 21 and by the selector butts 22*b* and 22*c* of needles 22.

The selector butts 21*b* and 22*b* of needles 21 and 22 have outer edges 21*d* , 22*d* and inner edges 21*e*, 22*e*, while the selector butts 21*c*, 22*c* have outer edges 21*f*, 22*f* and inner edges 21*g*, 22*g*. Each of the tucking cam 26 includes an outward slanting part 26*a* which engages, when the tucking cam 26 is in operative position, the inner edges 21*e*, 22*e* of the first selector butts 21*b*, 22*b* of the needles 21, 22 just after the master butts 21*a*, 22*a* pass into the entrance 24*a* of the outer guarding cam 24 and moves the needles 21, 22 to the tucking position. Tucking cam 26 also includes an inward slanting part 26*b* which controls the retraction of the needles 21 and 22 and linear part 26*c* which engages the outer edges 21*f* and 22*f* of the second selector butts 21*c* and 22*c* immediately after the needles 21, 22 move to the tucking position and maintains the needles in that position.

The knitting cams 27 include outward slanting parts 27*a* which are parallel to the outward slanting part 24*b* of the outer guarding cam 24 and engage the inner edges 21*g*, 22*g* of the second selector butts 21*c*, 22*c* of the needles 21, 22 just after the master butts 21*a*, 22*a* enter the entrance 24*a* of the cam 24 to advance the knitting needles 21, 22 to the knitting position when the respective knitting cams 27 are in the operative position. The knitting cams 27 further include inward slanting parts 27*b* which are parallel to the inward slanting part 24*c* of the cam 24 and the inward slanting part 25*a* of the stitch cam 25. The inward slanting parts 27*b* control the retraction of the needles 21 and 22.

Each of the cam sections 20A and 20B also includes welt guarding cams 28 which include inward slanting parts 28*a* which are generally parallel to inward slanting parts 25*a*, 26*b* and 27*b* of cams 25, 26 and 27 and which engage the outer edges 21*d*, 22*d* of the first selector butts 21*b*, 22*b* immediately after the needles 21, 22 move to the tucking position and moves these needles to the welting position. Cams 28 also include substantially linear parts 28*b* which engage the outer edges 21*d*, 22*d* of first selector butts 21*b*, 22*b* when the needles 21, 22 reach the welting position and restrains the needles from any unnecessary outward movement.

The cams 26, 27 and 28 include cam parts and rectangular bases 26*d*, 27*d* and 28*d* which are preferably integrally formed, but which may be formed separately and connected together if desired (FIG. 2). Bases 26*d*, 27*d* and 28*d* are closely received in rectangular slots or grooves 23*a* in cam holder 23 to prevent the cams 26, 27 and 28 from rotating and to guide the cams in their sliding movement between the inoperative and operative positions. At the same time, movement of the longitudinal edge parts of the cams is limited by a plate 30 mounted on cam holder 23 by screws 31.

Figure 3:
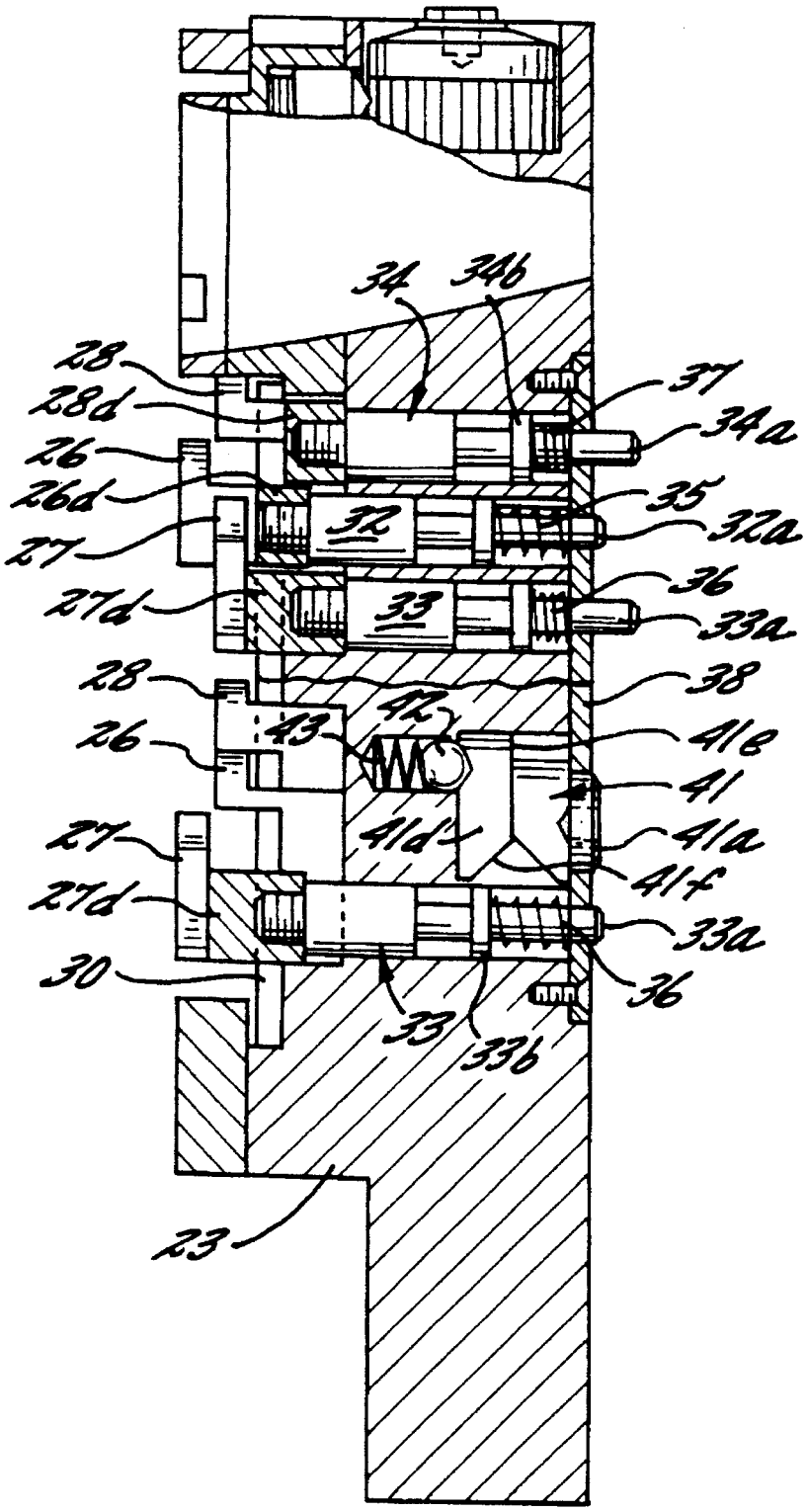
FIG. 3 is a sectional view taken substantially along line 3—3 in FIG. 2.

The bases 26*d*, 27*d* and 28*d* are connected to the inner ends of operating pins 32, 33 and 34, respectively. Pins 32, 33 and 34 penetrate through holes in the cam holder 23 which communicate with a large recess in the rear surface of the cam holder 23. The pins 32, 33 and 34 have reduced diameter end portions 32*a*, 33*a* and 34*a* on the ends thereof opposite the cams 26, 27 and 28. Further, the pins 32, 33 and 34 have cam follower portions 32*b*, 33*b* and 34*b* on the reduced end portions thereof. Springs 35, 36 and 37 are positioned around the reduced end portions 32*a*, 33*a* and 34*a* of the pins 32, 33 and 34 between the cam follower portions 32*b*, 33*b* and 34*b* and a cover plate 38 mounted on the rear of cam holder 23 (FIG. 3). Springs 35, 36 and 37 bias the operating pins 32, 33 and 34 to extended positions to position cams 26, 27 and 28 in their operative positions for engagement with the selector butts of the needles 21 and 22.

Figure 5:
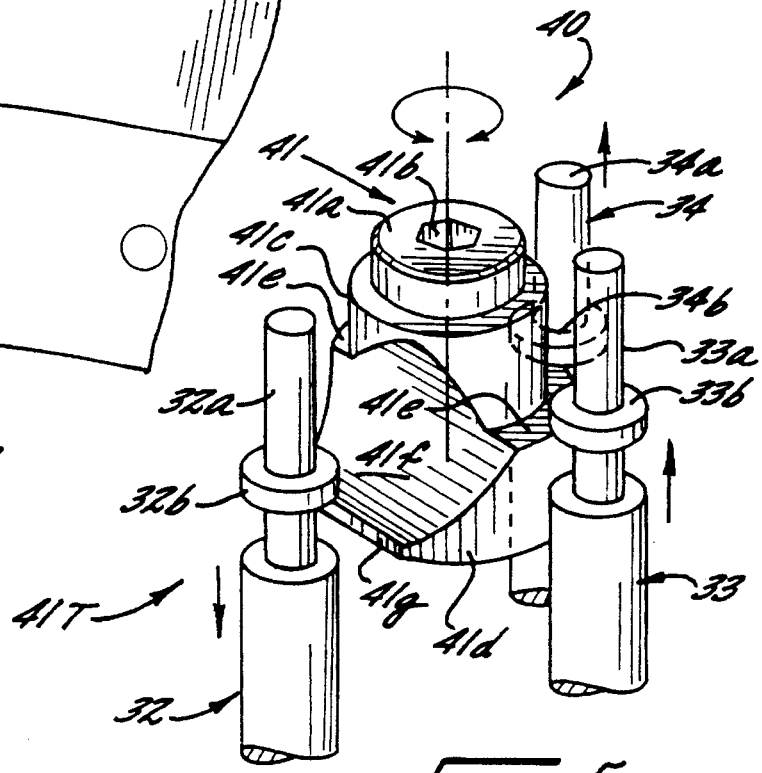
FIG. 5 is an enlarged perspective view of one of the cam selection and moving means.

A cam and needle selection mechanism 40 is provided for each set of cams 26, 27 and 28 for moving selected cams 26, 27 and 28 to the retracted, inoperative positions (FIG. 5). Selection mechanism 40 includes a rotary member 41 contained in the recess in the rear surface of cam holder 23. Rotary member 41 has a reduced diameter outer end position 41*a* that is received in an opening in the cover plate 38 to journal the rotary member 41 for rotation. The outer end portion 41*a* has a recess 41*b* therein which is preferably hexagonal in cross-section for insertion of an adjustment tool, such as an Allen wrench, for example.

Rotary member 41 also includes a medium diameter portion 41*c* and a large diameter portion 41*d*. The juncture between large diameter portion 41*d* and medium diameter portion 41*c* defines a shoulder 41*e* on the rear end of the large diameter portion 41*d*. On one side of the rotary member 41, the large diameter portion 41*d* and a portion of the medium diameter portion 41*c* is cut away to remove the shoulder 41*e* from that side of the rotary member 41 and to form an inclined surface 41*f* in the large diameter portion 41*d*. Inclined surface 41*f* functions as a double-acting cam engaged by the cam follower portions 32*b*, 33*b* and 34*b* of pins 32, 33 and 34 to force certain of the pins 32, 33, 34 to the retracted, inoperative positions, against the biasing action of springs 35, 36 or 37, upon clockwise and counter-clockwise rotation of rotary member 41 until the cam follower portions 32*b*, 33*b* or 34*b* move onto shoulder 41*e* and to permit others of the cam follower portions 32*b*, 33*b* or 34*b* of others of pins 32, 33, or 34 to move off of shoulder 41*e* and down the inclined surface 41*f* so that springs 35, 36 and 37 can move the pins 32, 33 and 34 to the extended positions and the cams 26, 27 and 28 to the operative positions. At the bottom end of the inclined surface 41*f* there is a linear part 41*g* which is cut out in a crescent shape.

On the bottom of large diameter portion 41*d* there are provided four recesses or detents 41*h*, 41*i*, 41*j* and 41*k* (FIG. 4) adapted to receive a ball 42 which is biased toward the rotary member 41 by a spring 43 (FIG. 3). By positioning the ball 42 is a certain one of the detents 41*h*, 41*i*, 41*j* or 41*k*, the rotary member 41 is held in position to select the knitting, tucking, welting or supporting positions.

Figure 6:
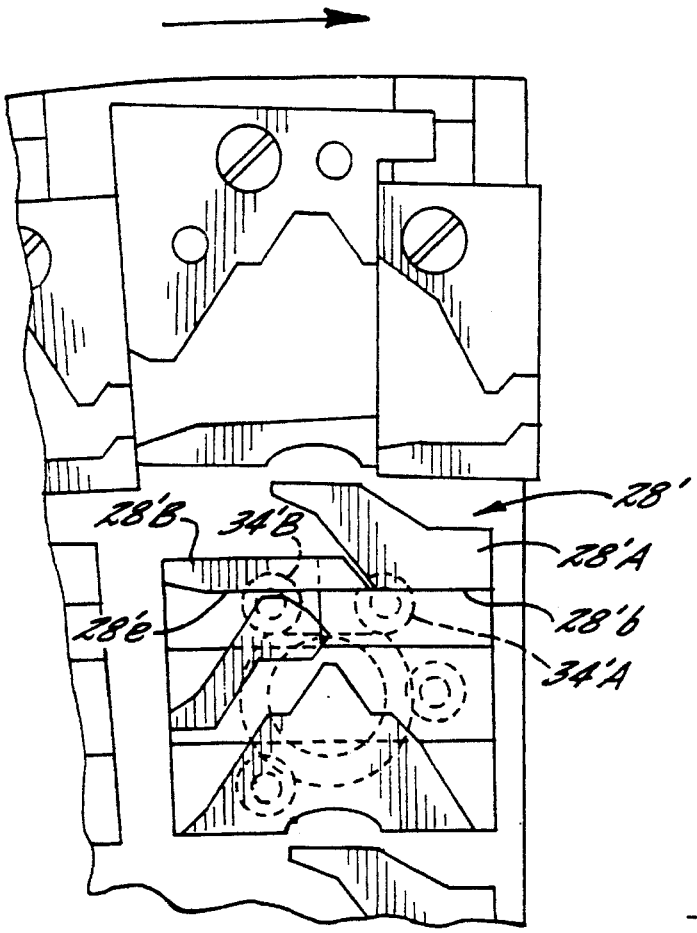
FIG. 6 is a fragmentary, front elevation of another embodiment of the cam mechanism of the present invention with the welt-guarding cam formed by two cam portions.
Figure 7:
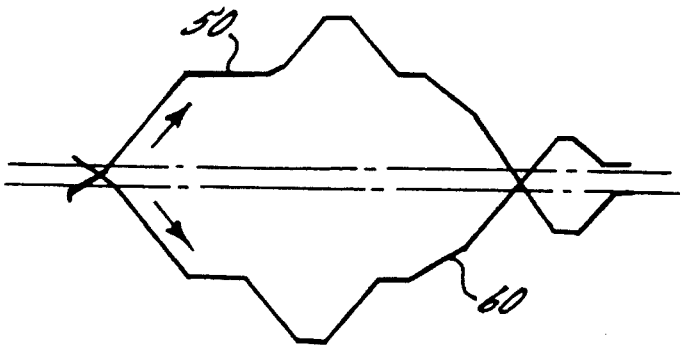
FIG. 7 is a schematic diagram of cylinder needle and dial needle movements with synchronized timing of the cylinder and dial cam mechanisms.

Referring now to FIG. 6, an alternate embodiment of the welt-guarding cam 28' is therein illustrated and like or similar parts are referenced by like reference characters with the prime notation added. In this embodiment, the welt guarding cam 28' may be divided into two parts 28'A and 28'B (FIG. 6). In this embodiment, cam part 28'B has a linear part 28'*e* which is aligned with and connected to linear part 28'*b* on cam part 28'A and cam parts 28'A and 28'B are individually and simultaneously movable to the extended, operative and retracted, inoperative positions. Accordingly, cam parts 28'A and 28'B are provided with operating pins 34'A and 34'B at the positions shown in FIG. 6.

Figure 4:
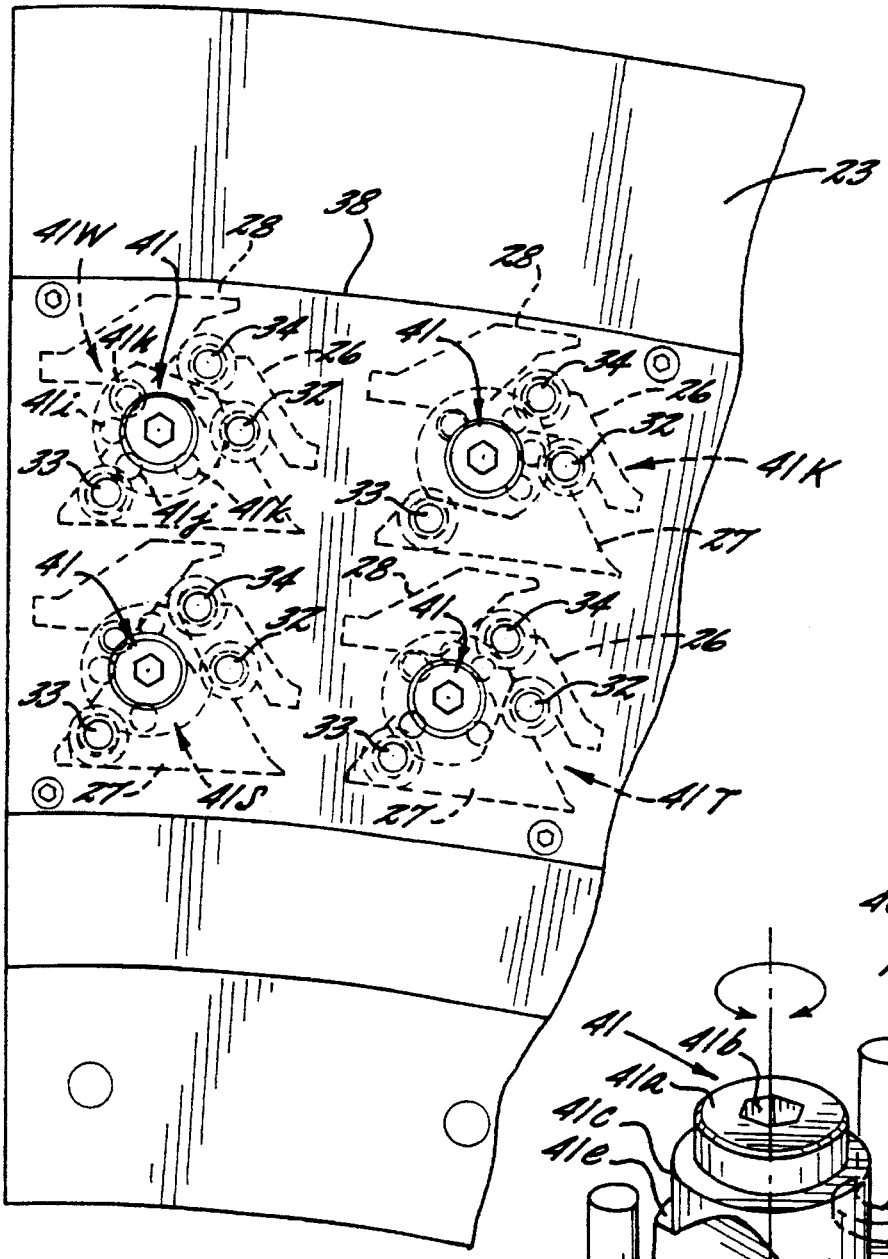
FIG. 4 is a fragmentary, rear elevation of the cam mechanism shown in FIG. 2.

Referring now to FIG. 4, the four positions of the rotary member 41 are illustrated and the operation of each position will be described. The upper right illustration is the knitting selection position 41K and in this condition, the inclined surface 41*f* has raised the operating pins 32 and 34 onto the shoulder 41*e* and retracted the tucking cam 26 and the welt-guarding cam 28 to the inoperative position. Operating pin 33, on the other hand, is positioned at the bottom of inclined surface 41*f* and only knitting cam 27 is in the operative position to be engaged by the selector butt 21*c* of knitting needle 21.

In the upper left illustration 41W, the rotary member 41 is in the welting selection position and the inclined surface 41*f* has raised operating pins 32 and 33 onto the shoulder 41*e* and has retracted tucking cam 26 and knitting cam 27 to their inoperative positions. In this condition, operating pin 34, or pins 34'*a* and 34'*b* in FIG. 6, is/are positioned at the bottom of inclined surface 41*f* and only welt-guarding cam 28 or 28' is in the operative position to be engaged by selector butt 21*b* of needle 21.

The lower right illustration 41T shows the rotary member 41 in the tucking selection position and the inclined surface 41*f* has raised operating pins 33 and 34 onto shoulder 41*e* and retracted to their inoperative positions the knitting cam 37 and welt-guarding cam 28. Operating pin 32, on the other hand, is positioned at the bottom of the inclined surface 41*f* and only tucking cam 26 is in the operative position to be engaged by selector butt 22*b* of needle 22.

In the lower left illustration 41S, the rotary member 41 is in the supporting selection position and the inclined surface has raised operating pin 33 onto the shoulder 41*e* and retracted to the inoperative position knitting cam 27. On the other hand, operating pins 32 and 34 are at the bottom of inclined surface 41*f* and tucking cam 26 and welt-guarding cam 28 are in their operative positions for engagement with selector butt 22*b* of needle 22. At the yarn feed where only a cylinder needle is used for knitting for patterning purposes, this supporting selection position of rotary member 41 restrains raising of the loop that may otherwise occur corresponding to the raising of the cylinder needle, thereby helping the loop to escape the hook when, for example, knitting a ripple pattern.

With reference to FIG. 1, the knitting action of knitting needles 21 and 22 will be described. It is noted that the cams 26, 27 and 28 that are in the operative position are shown in full lines while the cams in their inoperative positions are shown in dotted lines.

The knitting needles 21 and 22 rotate in the direction of the arrow at the top of FIG. 1. In cam section 20A, only the master butt 21*a* of needle 21 engages the outer guarding cam 24 and moves horizontally along the linear part 24*d* (welting position). The selector butts 21*b* and 21*c* do not engage cams 26 and 27 because these cams are retracted to their inoperative positions. Welt-guarding cam 28 is in the operative position and the selector butt 21*b* passes along linear part 28*b* and is restrained thereby from any unnecessary outward movement. Knitting needle 22 is advanced outward by its second selector butt 22*c* engaging the outward slanting part 27*a* of knitting cam 27. At the same time, the master butt 22*a* engages and is restrained by the outward slanting part 24*b* of outer guarding cam 24. When the master butt 22*a* and second selector butt 22*c* of needle 22 reach the top of the outward slanting parts 24*b* and 27*a*, needle 22 is in the knitting position. Upon further movement of needle 22, master butt 22*a* engages inward slanting part 24*c* which retracts needle 22 inwardly while second selector butt 22*c* engages and is restrained by the inward slanting part 27*b* of knitting cam 27. At the end of inward slanting part 24*c*, the master butt 22*a* engages inward slanting part 25*a* of stitch cam 25 and needle 22 is retracted thereby to its innermost position, i.e. the stitch-forming level.

In cam section 20B, knitting needle 21 is advanced outwardly by having its first selector butt 21*b* engage the outward slanting part 26*a* of upper tucking cam 26 until it reaches the top of cam 26 which is the tucking position. Needle 21 then moves horizontally in the tucking position until master butt 21*a* engages the inward slanting part 25*a* of stitch cam 25 which retracts inwardly needle 21 until it reaches the innermost or welting position. Also, needle 22 is advanced outwardly by engagement of its first selector butt 22*b* with the outer slanting part 26*a* of the lower tucking cam 26 until needle 22 reaches the tucking position at the top of cam 26. Thereafter, needle 22 is retracted inwardly by engagement of its master butt 22*a* with the inward slanting part 25*a* of stitch cam 25 until needle 22 reaches its innermost or welting position.

The knitting needles 21 and 22 continue their rotation with the dial and are advanced, retracted or retained in the welting position by the cams 24, 25, 26, 27 and 28 depending on the knitting pattern. This knitting pattern is set by positioning the rotary members 41 in their various positions 41*k*, 41*t*, 41*w* or 41*s*.

Figure 8:
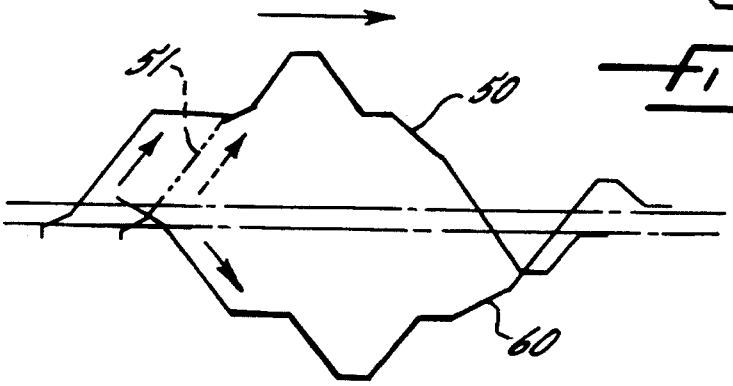
FIG. 8 is a schematic diagram of cylinder needle and dial needle movements with delayed timing of the cylinder and dial cam mechanisms.

In FIG. 8, there is illustrated a knitting operation diagram in which the dial cam mechanism and the needle cylinder cam mechanism are synchronized, which is referred to as "synchronized cam timing." FIG. 9 illustrates a knitting operation diagram in which the dial cam mechanism operates relative to the needle cylinder cam mechanism in a delayed manner, which is referred to as "delayed cam timing." In FIGS. 8 and 9, full line 50 represents the path of travel of the outer tip of the hook of a cylinder needle while full line 60 represents the path of travel of the outer tip of the hook of a dial needle.

Synchronized cam timing is changed to delayed cam timing by adjusting circumferentially the dial cam holder support which supports the dial cam holder 23 in a manner not shown. Heretofore, when using delayed cam timing, the fabric may be stretched inordinately, especially by a nep or knot in the yarn, because the cylinder needles and dial needles rise and advance at different times. Sometimes, this makes the knitting operation difficult depending on the type of fabric being knit.

By the present invention this difficulty is overcome by appropriate setting of the cam and needle selection means 40. As shown in FIG. 9 by the dash-line 51, the cylinder needle can be raised at the same time as the dial needle is advanced thereby avoiding inordinate stretching of the fabric. Consequently, the prior troublesome switching of cams becomes unnecessary and the cam timing is easily set by the needle selection means 40.

In the drawings and the specification, there have been set forth preferred embodiments of the invention, and, although specific terms are employed, the terms are used in a generic and descriptive sense only and not for the purpose of limitation, the scope of the invention being set forth in the following claims.

That which is claimed is:

1. A cam mechanism for a circular knitting machine having at least two kinds of needles each having a master butt and at least two spaced-apart selector butts arranged in spaced relation to the master butt, said cam mechanism comprising a stitch cam engageable by the master butts of all needles which have been advanced to knitting or tucking positions for retracting these needles to a stitch-forming level, a knitting cam mounted for movement between an extended, operative position and a retracted, inoperative position, said knitting cam being adapted when in the extended, operative position to be engaged by one of the selector butts of the needles to advance such needles outwardly to the knitting position, a tucking cam mounted for movement between an extended, operative position and a retracted, inoperative position, said tucking cam being adapted when in the extended, operative position to be engaged by one of the selector butts of the needles for advancing such needles outwardly to the tucking position, a welt-guarding cam mounted for movement between an extended, operative position and a retracted, inoperative position, said welt-guarding cam being adapted when in the extended operative position to be engaged by one of the selector butts of the needles for retracting such needles inwardly to a welting position, and selection means operatively associated with said knitting, tucking and welt-guarding cams for individually selecting and moving said knitting, tucking and welt-guarding cams between the operative and inoperative positions.

2. A cam mechanism according to claim 1 wherein at one stage in the knitting operation said selection means is in a knitting mode and selects and moves said knitting cam to the extended, operative position while retracting said tucking and welt-guarding cams to the inoperative positions.

3. A cam mechanism according to claim 2 wherein at another stage of the knitting operation said selection means is in a tucking mode and selects and moves said tucking cam to the operative position while retracting said knitting and welt-guarding cams to the inoperative positions.

4. A cam mechanism according to claim 3 wherein at still another stage of the knitting operation said selection means is in a welting mode and selects and moves said welt-guarding cam to the extended, operative position while retracting said knitting and tucking cams to the inoperative positions.

5. A cam mechanism according to claim 4 wherein at a still further stage of the knitting operation said selection means is in a supporting mode and selects and moves said tucking and welt-guarding cams to their operative positions while retracting said knitting cam to the inoperative position.

6. A cam mechanism according to claim 1 including a cam holder on which said stitch, knitting, tucking and welt-guarding cams are mounted.

7. A cam mechanism according to claim 6 wherein said cam holder has a front face and rear face and recesses in said front face at the positions of said knitting, tucking and welt-guarding cams, said stitch cam being stationarily mounted on the front face of said cam holder in the path of travel of the master butts of the knitting needles, said knitting, tucking and welt-guarding cams being movably mounted on said cam holder and receivable in said recesses when in the retracted, inoperative positions and being disposed out of the recesses and in the path of the selector butts of the needles when in the extended, operative positions.

8. A cam mechanism according to claim 7 wherein said knitting, tucking and welt-guarding cams each include an operating pin extending through said cam holder from the front face to the rear face and wherein said selection means is carried by the rear face of said cam holder in operative association with said operating pins.

9. A cam mechanism according to claim 8 wherein said selection means includes spring means biasing said knitting, tucking and welt-guarding cams toward their extended, operative positions and retraction means selectively engageable with said operating pins to select and move individual ones of said knitting, tucking and welt-guarding cams to their inoperative positions.

10. A cam mechanism according to claim 9 wherein said operating pins include cam followers thereon, and said retraction means comprises a rotatable member having an inclined surface on one side thereof and a shoulder at the top of said inclined surface, said inclined surface serving as a cam engageable by selected cam followers on said operating pins to retract corresponding ones of said knitting, tucking and welt-guarding cams to their inoperative positions.

11. A cam mechanism according to claim 1 wherein said welt-guarding cam comprises first and second cam members individually and independently mounted for individual and collective movement between the operative and inoperative positions.

12. A cam mechanism for a circular knitting machine having multiple yarn feeds and at least two kinds of needles, each of said needles having a master butt at a predetermined location on a shank of the needle and at least two spaced-apart selector butts on the shank of the needles in spaced relation to the master butt, the two kinds of needles having the master butts at the same location on the shanks thereof and the selector butts at different locations on the shanks thereof, said cam mechanism comprising a cam holder having cam sections corresponding in number to the number of yarn feeds on the circular knitting machine, a stitch cam mounted on said cam holder at each cam section and engageable by the master butts of all needles which have been advanced outwardly to a knitting position or a tucking position for retracting those needles to a stitch-forming level, two sets of cams mounted on said cam holder at each cam section in the same spaced relation as the locations of the selector butts are spaced on the shanks of the two kinds of needles, each of said sets of cams comprising a knitting cam, a tucking cam and a welt-guarding cam, said knitting, tucking and welt-guarding cams being selectively and individually movable between extended, operative positions in the path of travel of the selector butts on the needles for advancing or retracting the needles to the knitting, tucking or welting positions and retracted, inoperative positions out of the path of the selector butts of the needles, and selection means for each set of cams for individually selecting and moving said knitting, tucking and welt-guarding cams between the extended, operative position and the retracted, inoperative position.

13. A method of needle selection in a circular knitting machine comprising providing at least two kinds of knitting needles, each having a master butt at a predetermined location on a shank thereof and at least two spaced apart selector butts in spaced relation to the master butt;

rotating the knitting needles along a circular path of travel;

providing yarn feeds at multiple locations around the circular path of travel and feeding yarn to the needles as the needles move past the yarn feeds;

providing multiple cam sections equal in number to the yarn feeds, each cam section including a stitch cam in the path of travel of the master butts of the needles, and knitting, tucking and welt-guarding cams movable individually and independently between extended operative positions and retracted inoperative positions; and selecting and moving the knitting, tucking or welt-guarding cams between the operative and inoperative positions at the various cam sections in accordance with a predetermined pattern to selectively engage the selector butts of the needles and advance or retract the needles to or from knitting, tucking or welting positions.

14. A method according to claim 13 wherein said predetermined pattern includes selecting the knitting cams at those cam sections where the needles are to be moved to the knitting position and moving the knitting cams from the inoperative position to the operative position in the path of the selector butts of the needles, while retracting the tucking and melt-guarding cams to their inoperative positions.

15. A method according to claim 14 including selecting the tucking cams at those cam sections where the needles are to be moved to the tucking position and moving the tucking cams to the operative position in the path of the selector butts of the needles while retracting the knitting and melt-guarding cams to their inoperative positions.

16. A method according to claim 15 including selecting the melt-guarding cams at those cam sections where the needles are to occupy the melting position and moving the melt-guarding cams to the operative position in the path of the selector butts of the needles while retracting the knitting and tucking cams to their inoperative positions.

17. A method according to claim 16 including selecting the tucking and melt-guarding cams at those cam sections where the needles are to occupy a supporting position and moving the tucking and melt-guarding cams to their operative positions in the path of the selector butts of the needles while retracting the knitting cams to their inoperative positions.

18. A method of cam timing setting in a circular knitting machine having a needle cylinder and a dial and at least two kinds of needles each having a master butt and at least two selector butts, said method comprising providing a cam mechanism for the needles including a stitch cam for engaging the master butts of the needles for retracting the needles from knitting and tucking positions to a stitch-forming level and further including knitting, tucking and welt-guarding cams movable between extended operative and retracted inoperative positions;

setting the cam mechanism for delayed cam timing between cylinder needles and dial needles, and selecting and moving the knitting, tucking and welt-guarding cams in such a manner that the cylinder needles and dial needles start crossing at the same time as they pull simultaneously.

* * * * *